US008997716B2

(12) United States Patent
Ferry et al.

(10) Patent No.: US 8,997,716 B2
(45) Date of Patent: Apr. 7, 2015

(54) CONTROLLED NOZZLE INJECTION METHOD AND APPARATUS

(75) Inventors: William Ferry, Southwick, MA (US); Martin G. Riccitelli, Hampden, MA (US); Richard Vanderpoel, Bloomfield, CT (US)

(73) Assignee: Governors America Corp., Agawam, MA (US)

( * ) Notice: Subject to any disclaimer, the term of this patent is extended or adjusted under 35 U.S.C. 154(b) by 741 days.

(21) Appl. No.: 13/294,421

(22) Filed: Nov. 11, 2011

(65) Prior Publication Data

US 2012/0118269 A1 May 17, 2012

Related U.S. Application Data

(60) Provisional application No. 61/413,719, filed on Nov. 15, 2010.

(51) Int. Cl.

| | |
|---|---|
| ***F02M 69/46*** | (2006.01) |
| ***F02M 63/00*** | (2006.01) |
| ***F02M 59/46*** | (2006.01) |
| ***F02M 63/02*** | (2006.01) |

(52) U.S. Cl.

CPC ..... *F02M 63/0005* (2013.01); *F02M 59/462* (2013.01); *F02M 59/464* (2013.01); *F02M 63/0245* (2013.01); *F02M 63/025* (2013.01); *F02M 63/027* (2013.01)

(58) Field of Classification Search

CPC ..... F02M 59/462; F02M 59/464; F02M 63/0005; F02M 63/0245; F02M 63/025; F02M 63/027; F02M 63/0007; F02M 63/0265; F02M 55/002; F02M 55/02; F02M 55/025; F02M 59/361

USPC ..... 123/447, 456, 457, 459, 461, 467, 478, 123/490, 506, 510, 511, 512, 514; 239/88–92

See application file for complete search history.

(56) References Cited

U.S. PATENT DOCUMENTS

| | | | | |
|---|---|---|---|---|
| 3,257,999 | A * | 6/1966 | Fiedler | 123/90.12 |
| 4,633,837 | A * | 1/1987 | Babitzka et al. | 123/478 |
| 5,295,470 | A * | 3/1994 | Straubel | 123/458 |
| 5,839,414 | A * | 11/1998 | Klinger et al. | 123/467 |
| 5,852,997 | A * | 12/1998 | Vanderpoel | 123/446 |
| 6,484,698 | B2 * | 11/2002 | Boecking | 123/467 |
| 6,491,025 | B2 * | 12/2002 | Ferry et al. | 123/456 |
| 7,293,547 | B2 * | 11/2007 | Ibrahim | 123/446 |
| 7,549,410 | B2 * | 6/2009 | Yudanov | 123/506 |
| 8,132,558 | B2 * | 3/2012 | Lucas et al. | 123/510 |
| 2005/0039724 | A1 * | 2/2005 | Ishida et al. | 123/447 |
| 2005/0045149 | A1 * | 3/2005 | Udd et al. | 123/446 |

* cited by examiner

*Primary Examiner* — Erick Solis
*Assistant Examiner* — Carl Staubach
(74) *Attorney, Agent, or Firm* — McCormick, Paulding & Huber LLP

(57) ABSTRACT

A nozzle injection apparatus for use in internal combustion engines includes a fuel pump for intermittently pressurizing fuel, an injection conduit in fluid communication with the fuel pump, the injection conduit permitting the pressurized fuel to be communicated to a fuel injection nozzle a control valve in fluid communication with the nozzle, wherein the control valve dynamically and selectively controls a pressure of said pressurized fuel within the injection conduit.

3 Claims, 6 Drawing Sheets

CONTROLLED NOZZLE INJECTION METHOD AND APPARATUS

CROSS REFERENCE TO RELATED APPLICATIONS

This application claims the benefit of U.S. Provisional Application Ser. No. 61/413,719, filed on Nov. 15, 2010, entitled "CONTROLLED NOZZLE INJECTION METHOD AND APPARATUS," which is hereby incorporated by reference in its entirety.

FIELD OF THE INVENTION

This invention relates in general to a controlled nozzle injection method and apparatus, and deals more particularly with a controlled nozzle injection method and apparatus which operates to reduce the amount of polluting contaminants emitted by an internal combustion engine.

BACKGROUND OF THE INVENTION

Internal combustion engines are well known power generating devices which may have any number of differing configurations in dependence upon the type of fuel utilized, their size and the particular environment in which they are designed to operate.

Although several electronic fuel delivery systems for internal combustion vehicles are known to provide adequate performance characteristics, these systems tend to be expensive and do not address those motorized vehicles which include non-electronic fuel delivery systems. In those systems which utilize standard mechanical pumps for this purpose, there exists several inherent inefficiencies which the present invention seeks to address.

As can be seen in FIG. 1, a known fuel delivery system 10 of a typical high pressure, diesel engine utilizes a mechanical pump 12 (also referred to as a jerk pump or a block pump), and an unillustrated arrangement of camshafts and plungers, to intermittently provide a predetermined amount of fuel from a fuel supply 14 to a fuel injector 16 via an injection line. The nozzle of the fuel injector 16 operates to atomize the fuel as it enters the high pressure air combustion chamber of the engine.

In operation, pressure within the fuel injector 16 continues to build as the pump 12 provides fuel to the fuel injector 16 at the onset of a given fuel delivery cycle. A spring biased injector valve 22, typically a needle valve or the like of the fuel injector 16, opens in response to the pressure building within the fuel injector 16, thereby causing fuel to be dispensed through a series of passageways and into the vehicle's combustion chamber.

FIG. 2 is a graph illustrating the pressure at the nozzle portion of the fuel injector 16 during the fuel delivery cycle, wherein a slight drop in pressure can be seen to occur at the start of the injection process (in certain instances a slight change in the slope of the pressure curve may be seen, rather than an actual drop in pressure), although pressure continues to build at a desired rate after fuel injection has begun. Fuel will therefore continue to be delivered to the combustion chamber of the vehicle until the pressure within the fuel injector falls below the return spring biasing force of the injector valve 22. In these known systems, residual fuel which is left in the nozzle portion of the fuel injector 16 after the injector valve 22 closes is typically vented from the nozzle portion via a nozzle leak-off valve, conduit or the like. In other systems, such as that of the present invention, the residual fuel is not vented and remains in the line until the next injection.

In such systems as described in conjunction with FIGS. 1 and 2 above, the pressure of the fuel has a direct effect on how the fuel atomizes as it leaves the fuel injector 16 and enters the combustion chamber, and hence on how the fuel burns within the combustion chamber of the vehicle. Larger droplets of fuel are provided to the combustion chamber of the vehicle during those times when the pressure at the nozzle portion of the fuel injector 16 is comparatively low. These larger droplets tend to take longer to evaporate, mix and burn and therefore may not be able to completely combust within the combustion chamber before being exhausted therefrom. In addition, such large, low pressure and low velocity droplets may not make it to the distal side of the combustion chamber to mix with all the air. Such incomplete mixing and combustion aggravates pollution concerns, including the production of increased particulates, smoke, odor, hydrocarbons, carbon monoxide and the like.

It would therefore be advantageous to modify existing fuel delivery systems so as to reduce the generation of pollutants while increasing the efficiency of the fuel delivery system as a whole. Towards this end, the present invention seeks to raise the closing pressure of the injected fuel, while holding the starting pressure of the fuel injection at an elevated level.

It has been determined that by raising the closing pressure, the needle valve in the nozzles starts to close earlier as the pressure in the injection line begins to drop. The nozzle therefore tends to close completely before the line pressure goes to zero, thereby reducing the quantity of fuel injected at an undesirably low pressure. A problem exists in incorporating this pressure architecture with standard mechanical, or jerk, pumps because known mechanical pumps cannot reach the desired high opening and closing pressures to start at typical cranking speeds.

With the forgoing problems and concerns in mind, the present invention seeks to provide a controlled nozzle injection method and apparatus which operates in conjunction with known mechanical fuel pumps to reduce the amount of polluting contaminants emitted by an internal combustion engine.

SUMMARY OF THE INVENTION

It is an object of the present invention to provide a controlled nozzle injection device.

It is another object of the present invention to provide a controlled nozzle injection device which operates to reduce the amount of polluting contaminants emitted by an internal combustion engine.

It is another object of the present invention to provide a controlled nozzle injection device which elevates the pressure at the beginning of the fuel delivery cycle.

It is another object of the present invention to provide a controlled nozzle injection device which maintains higher pressures at the end of the fuel delivery cycle.

It is another object of the present invention to provide a controlled nozzle injection device that allows for the pressure at each nozzle to be independently, dynamically and selectively controlled.

According to one embodiment of the present invention, a nozzle injection apparatus for use in internal combustion engines includes a fuel pump for intermittently pressurizing fuel and an injection conduit in fluid communication with the fuel pump, the injection conduit permitting the pressurized fuel to be communicated to a fuel injection nozzle. A high pressure manifold in fluid communication with the fuel pump and the nozzle is also provided to accumulate the pressurized fuel which is residually left in the injection conduit between intermittent pressurizations of the fuel.

According to another embodiment of the present invention, a nozzle injection apparatus for use in internal combustion engines includes a fuel pump for intermittently pressurizing fuel, an injection conduit in fluid communication with the fuel pump, the injection conduit permitting the pressurized fuel to be communicated to a fuel injection nozzle a control valve in fluid communication with the nozzle, wherein the control valve dynamically and selectively controls a pressure of said pressurized fuel within the injection conduit.

These and other objectives of the present invention, and their preferred embodiments, shall become clear by consideration of the specification, claims and drawings taken as a whole.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 3:
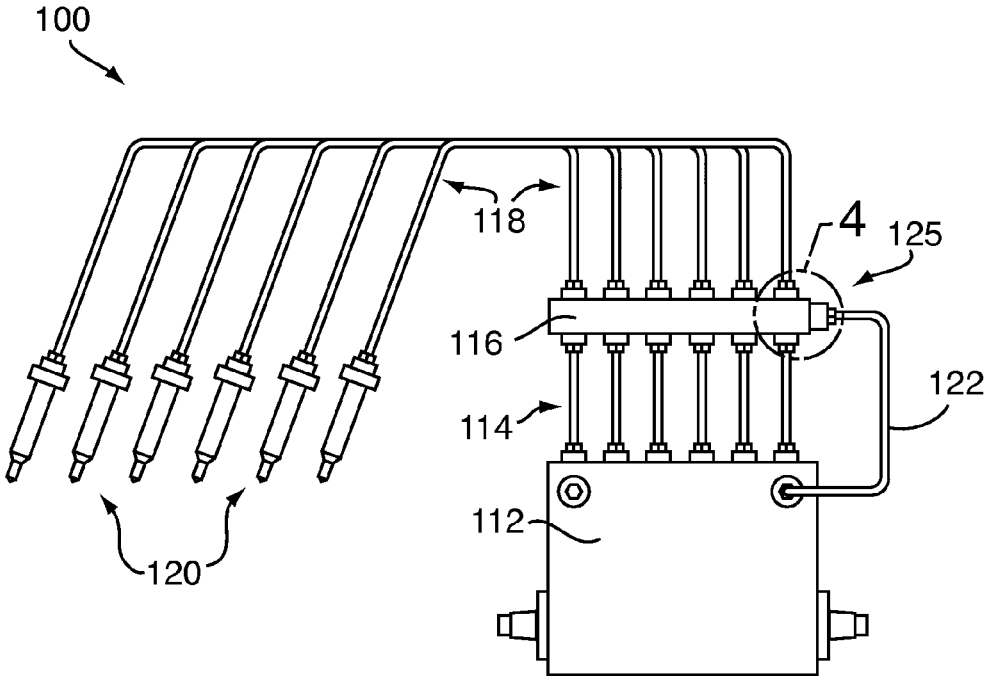
FIG. 3 illustrates a controlled nozzle injection apparatus according to one embodiment of the present invention.

FIG. 3 illustrates a controlled nozzle injection apparatus 100 according to one embodiment of the present invention. As illustrated in FIG. 3, a fuel injection pump 112 is provided to intermittently supply the injection apparatus 100 with a pressurized stream of fuel, typically a hydrocarbon fuel comprising gasoline, diesel fuel or the like. The pump 112 operates to send streams of pressurized fuel through, in succession, a plurality of fuel transport conduits 114, a high pressure manifold 116, a plurality of fuel injection conduits 118 and, finally, to a plurality of fuel injector nozzles 120 which exhaust the fuel streams into an unillustrated combustion chamber of a vehicle. A fuel return conduit 122 is also provided for depressurizing the high pressure manifold 116, as will be described in more detail later.

Each of the nozzles 120 typically include a known arrangement of needle valves or the like which, when subjected to a threshold pressure, will permit passage of the pressurized fuel into the combustion chamber. The nozzles 120 do not, however, include leak off valves, conduits or the like which are typically provided to known nozzle assemblies to evacuate residual fuel therefrom like (as discussed previously). The present embodiment utilizes such leakless nozzles in order to trap residual, pressurized fuel within the spring chamber of the needle valves for subsequent use, as will be described in more detail later. Moreover, although there are a discreet number of conduits and fuel injector nozzles shown in FIG. 3, it will be readily appreciated that the present invention contemplates the incorporation of any number of conduits or nozzles without departing from the broader aspects of the present invention.

Figure 4:
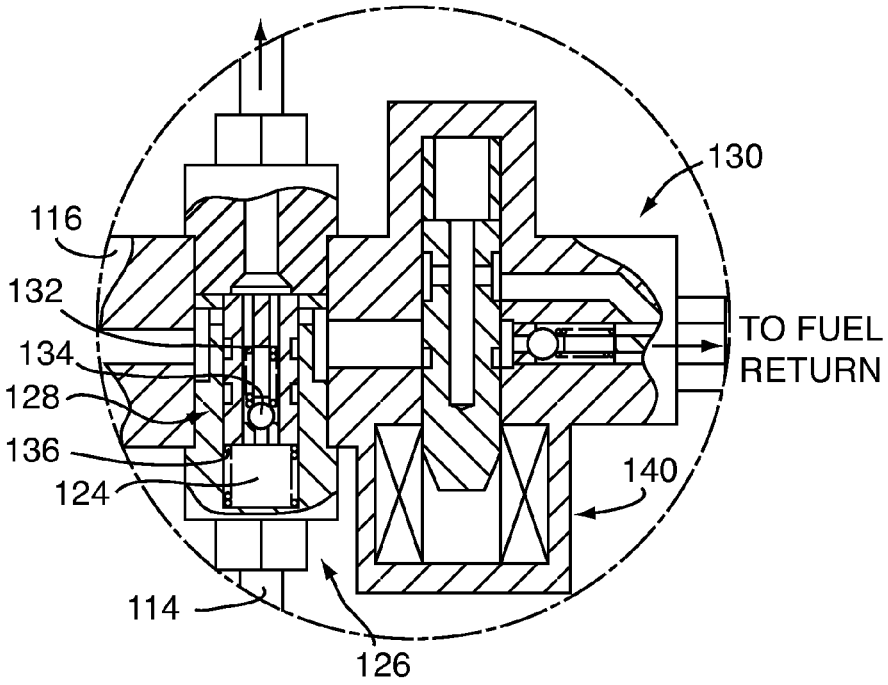
FIG. 4 is an enlarged, partial cross-sectional view of a valve assembly utilized in the injection apparatus of FIG. 3.

Returning to FIG. 3, the high pressure manifold 116 is provided with a plurality of differing valve sets 125 which are utilized to control the flow and pressure of the fuel streams provided by the fuel pump 112. FIG. 4 is an enlarged, partial cross-sectional view of the valve sets 125 utilized to control the flow and pressure of the fuel streams in accordance with the present invention.

As shown in FIG. 4, a check valve assembly 126 works in concert with a spool valve assembly 128 and a pressure relief valve assembly 130 to bootstrap residual pressure left in the injection apparatus 100 at the conclusion of each fuel cycle back into the injection apparatus 100. By doing so, the present invention seeks to maintain high fuel injection pressures at the end of the fuel delivery cycle, similar to the high injection pressures present at the beginning of the fuel delivery cycle.

Operation of the injection apparatus 100 will now be described in conjunction with FIGS. 3 and 4. At the beginning of an initial fuel delivery cycle, the fuel pump 112 pressurizes a predetermined amount of fuel from an unillustrated fuel supply. As best seen in FIG. 4, the pressurized fuel travels through the transport conduit 114 and pools in a spring chamber 124 of a check valve assembly 126. Once the pressure within the spring chamber 124 overcomes the reverse biasing force of a check spring 132, a check ball valve 134 will be displaced, thereby allowing the pressurized stream of fuel to pass through the injection conduit 118 on the way to the nozzles 120 where a needle valve, or the like, opens and releases an atomized fuel stream into the combustion chamber of a motorized vehicle.

As pressure within the spring chamber 124 lessens at the end of the initial fuel delivery cycle, the check ball valve 134 will reassume its blocking position leaving a measured amount of residual fuel, and therefore pressure, trapped in the injection conduits 118. While known systems remove this residual pressure, the present invention redirects the remaining pressurized fuel to the high pressure manifold 116 for later use. Returning to FIG. 4, the residual pressurized fuel in the injection conduits 118 forces the spool valve assembly 128 to shift against the biasing force of a return spring 136 housed within the spring chamber 124. A passageway is thereby created which allows the pressurized fuel to be redirected to the high pressure manifold 116 for later use, the spool valve assembly 128 subsequently reassuming its original position. At this point, the needle valves of the nozzles 120 are also exposed to the residual fuel pressure in the injection conduits 118 and, therefore, a small amount of pressurized fuel will leak into an unillustrated spring chamber of the nozzles 120, and so the opening and closing pressures of the nozzles 120 will be somewhat higher for subsequent fuel deliver cycles.

As subsequent fuel delivery cycles are performed, the residual pressurized fuel will continue to be 'boot-strapped' into the high pressure manifold 116, as described above, until the injection conduits 118 and the high pressure manifold 116 have reached and stabilized at a predetermined elevated pressure. In one particular design embodiment, the pressure of the injection lines 118 and the high pressure manifold 116 are designed to stabilize at approximately 4000 psi, whereby detrimentally higher pressures are guarded against through the action of the pressure relief valve assembly 130 which shunts excessive pressure back to the fuel pump 112 for later use via the fuel return line 122.

Figure 5:
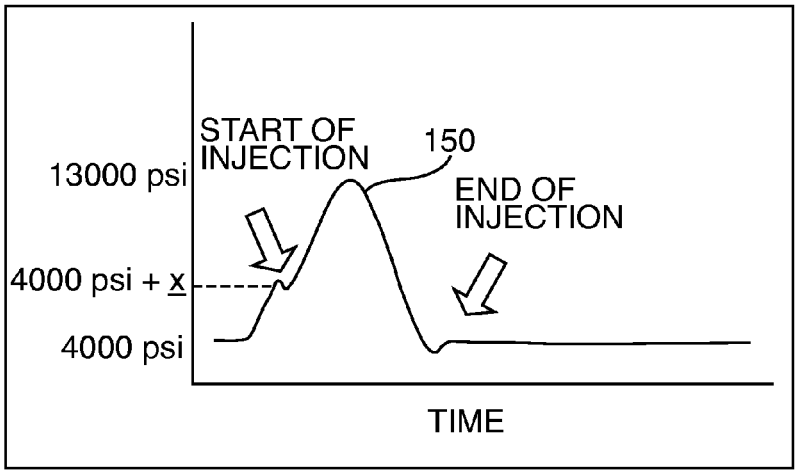
FIG. 5 is a graph illustrating the pressure at the nozzle portion of a fuel injector during the fuel delivery cycle according to the nozzle injection apparatus of FIG. 3.

As will now be appreciated, once a state has been reached in which the injection conduits 118 and the fuel manifold 116 have stabilized at a predetermined elevated pressure, each subsequent fuel delivery cycle will begin and end at a scaled pressure which is substantially higher than normal and higher than the predetermined elevated pressure. A graph illustrating the forgoing pressure architecture during operation of the injection apparatus 100 is shown in FIG. 5. As can be seen from FIG. 5, subsequent to the pressure within the injection conduits 118 and the fuel manifold 116 having stabilized, the pressure curve 150 has similar characteristics to the pressure curve of known fuel delivery systems, as illustrated previously in FIG. 2. In the present invention, however, FIG. 5 illustrates how the pressure of the injected fuel remains high even during the later stages of each fuel delivery cycle, owing to the elevated pressure maintained in the high pressure manifold 116 and the injection conduits 118 as a result of the bootstrapping of pressurized fuel.

Figure 2:
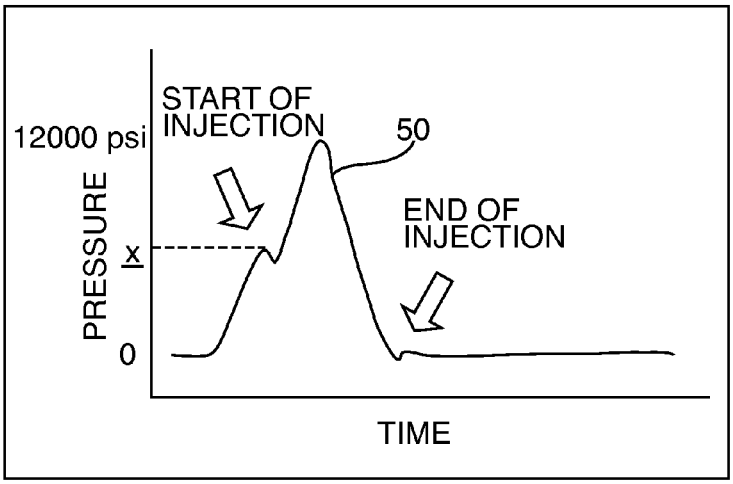
FIG. 2 PRIOR ART
FIG. 2 is a graph illustrating the pressure at the nozzle portion of a fuel injector during the fuel delivery cycle according to the fuel delivery system of FIG. 1.

In particular, when comparing the pressure curve 50 of FIG. 2 to the pressure curve 150 of FIG. 5, it will be apparent that the pressure at the nozzle at the onset of fuel injection may be represented by X that is, the dynamic pressure provided by the fuel pump which is sufficient to open the needle valve of the nozzle. In FIG. 5, owing to the bootstrapping of pressure and the use of leakless nozzles 120 (as described previously), the pressure at the nozzles 120 is represented by the residual pressure in the system, 4000 psi in FIG. 5, plus the dynamic pressure X provided by the fuel pump 112. In this manner, the present invention ensures that high opening and closing pressures may be maintained at the nozzles 120 during operation of the vehicle, resulting in a more complete combustion of injected fuel and a corresponding reduction in the pollutants exhausted therefrom.

It is therefore an important aspect of the present invention that the fuel streams provided to the combustion chamber of a motorized vehicle are maintained at an elevated pressure, especially at the nozzles 120, thereby ensuring a more complete combustion of these fuel streams and an associated reduction in exhausted polluting contaminants.

It is another aspect of the present invention that the injection apparatus 100 illustrated in FIGS. 3 and 4 may be incorporated onto existing motorized vehicles without incurring significant expenses. In order to accommodate the present invention into existing fuel delivery systems, an electrically actuated valve 140, typically a solenoid or the like, is provided to the pressure relief valve assembly 130. The solenoid valve 140 is actuated to vacate pressure within the high pressure manifold 116 during the initial cranking of the motorized vehicle's engine, to be in conformance with the motorized vehicle's original pressure design parameters. Once the vehicle has started, the solenoid valve would again be actuated to enable the fuel delivery routine as described above. While the primary function of the solenoid valve 140 is to reduce the build-up of pressure during a starting operation, the present invention also contemplates actuating the solenoid valve 140 in order to lower the opening and closing pressures of the nozzles 120 during low idle to reduce idling noise and the like.

Moreover, it should be noted that any additional expense incurred as a result of the incorporation of the more intricate valve assemblies of the present invention, as shown in FIG. 4, may be substantially offset by a reduction in other fuel delivery system components. In particular, as no 'leak-off' capability must be directly attributed to the nozzles 120, as is standard in known fuel delivery systems, there is no need to drill leak-off holes in the nozzles 120 and the associated tubing and hoses for such are correspondingly eliminated. The present invention is therefore less expensive to produce and install than existing systems, as well as being more efficient.

In certain circumstances, it may be necessary to adjust the tubing or conduit sizes, as well as the size of the nozzles 120 themselves, in order to make the injection apparatus 100 work as designed at all engine operating speeds and for all fuel delivery demands, and the present invention contemplates such modifications without departing from the broader aspects of the present invention. In particular, the present invention may require that the injection conduits have as much as a 40% larger diameter than is typically present in those systems which utilize hydraulic mechanical fuel pumps. This may be required to ensure that the total pressure at the fuel pump does not get too high. In operation, the pressure at the pump end of the injection conduits is approximately equal to the residual pressure within the conduits plus the dynamic pressure required to propagate the fuel wave down the conduits. The dynamic pressure therefore needs to be reduced, and since the dynamic pressure is approximately inversely proportional to the injection conduits' internal area, the internal area of the injection conduits may need to be made larger, as mentioned above.

It is therefore another important aspect of the present invention that by increasing the internal area of the injection conduits, enhanced performance may be readily obtained at the nozzle end of the injection conduits as well. In practice, the pressure available to inject the pressurized fuel into the combustion chamber is again the sum of the residual pressure within the injection conduits and the dynamic pressures. A larger internal area of the injection conduits will therefore allow more pressurized fuel to be available to maintain pressure on the nozzle as the needle closes the nozzle at the end of a fuel delivery cycle. Larger injection conduits also reduce the frictional losses associated with the system.

Figure 6:
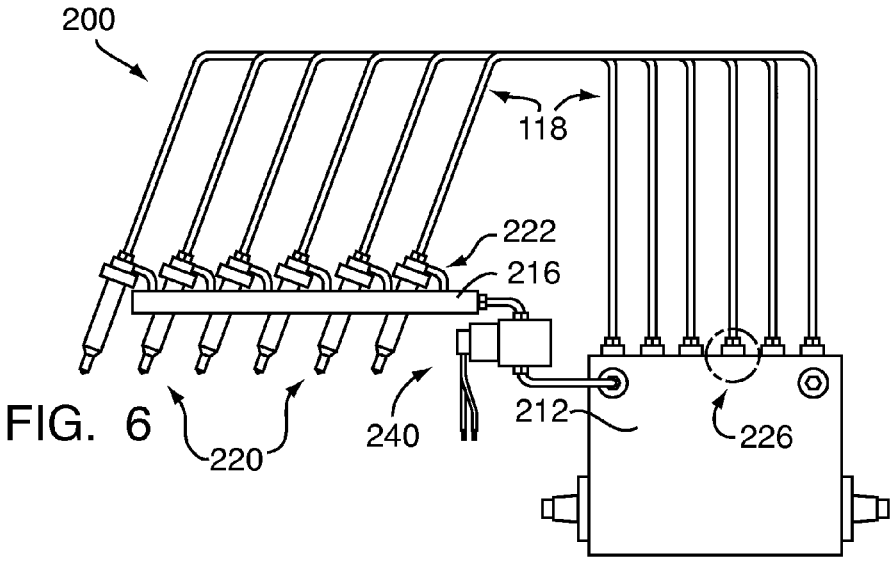
FIG. 6 illustrates a controlled nozzle injection apparatus according to another embodiment of the present invention.

FIG. 6 illustrates a controlled hydraulic nozzle injection apparatus 200 according to another embodiment of the present invention. As illustrated in FIG. 6, a fuel injection pump 212 is provided to intermittently supply the injection apparatus 200 with a pressurized stream of fuel, typically a hydrocarbon fuel comprising gasoline, diesel fuel or the like. The pump 212 operates to send streams of pressurized fuel through, in succession, a plurality of dual valve assemblies 226, a plurality of fuel injection conduits 218 and, finally, to a plurality of fuel injector nozzles 220 which exhaust the fuel streams into an unillustrated combustion chamber of a vehicle.

Each of the nozzles 220 typically include a known arrangement of needle valves or the like which, when subjected to a threshold pressure, will permit passage of the pressurized fuel into the combustion chamber. Moreover, although there are a discreet number of conduits and fuel injector nozzles shown in FIG. 6, it will be readily appreciated that the present invention contemplates the incorporation of any number of conduits or nozzles without departing from the broader aspects of the present invention.

Returning to FIG. 6, a high pressure manifold 216 is provided and is connected to each of the leak-off conduits 222 of the nozzles 220 in order to assist in boot-strapping residual pressurized fuel, as will be described in more detail later. The high pressure manifold 216 is further connected to the fuel pump 212 via an electrically actuated valve, typically a solenoid or the like, and serves to vacate pressurized fuel from the high pressure manifold 216, back to the fuel pump 212, when necessary.

Figure 7:
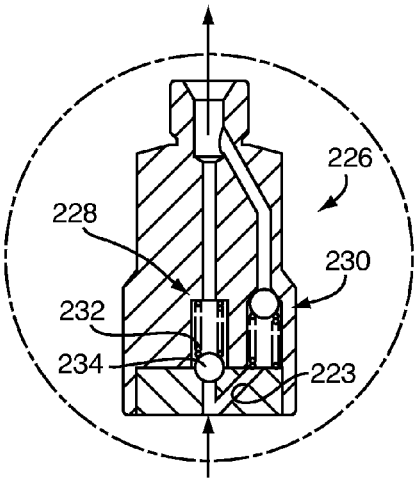
FIG. 7 is an enlarged, partial cross-sectional view of a dual valve assembly utilized in the injection apparatus of FIG. 6.

As more clearly illustrated in FIG. 7, the dual valve assembly 226 includes a check valve assembly 228 and a pressure relief valve assembly 230 which bootstraps residual pressure left in the injection apparatus 200 at the conclusion of each fuel cycle back into the injection apparatus 200. By doing so, the present invention seeks to maintain high fuel injection pressures at the end of the fuel delivery cycle, similar to the high injection pressures present at the beginning of the fuel delivery cycle.

Operation of the injection apparatus 200 will now be described in conjunction with FIGS. 6 and 7. At the beginning of an initial fuel delivery cycle, the fuel pump 212 pressurizes a predetermined amount of fuel from an unillustrated fuel supply. As best seen in FIG. 7, once the pressurized fuel overcomes the biasing force of a check spring 232, a check ball valve 234 will be displaced, thereby allowing the pressurized stream of fuel to pass through the injection conduits 218 on the way to the nozzles 220 where a needle valve, or the like, opens and releases an atomized fuel stream into the combustion chamber of a motorized vehicle.

At the end of the initial fuel delivery cycle, the check ball valve 234 will reassume its blocking position leaving a measured amount of residual fuel, and therefore pressure, trapped in the injection conduits 218. While known systems remove this residual pressure, typically by the retraction volume in the delivery valves, the present invention arrests the remaining pressurized fuel by virtue of the pressure relief valve assembly 230. Owing to this trapped, residual pressurized fuel in the injection conduits 218, a small amount of the pressurized fuel will be shunted through the leak-off conduits 222 and into the high pressure manifold 216 for later use. The leakage of pressurized fuel into the high pressure manifold 216 affects subsequent movement of the needle valve in the nozzles 220, and so the opening and closing pressures of the nozzles 220 will be somewhat higher for subsequent fuel deliver cycles.

As subsequent fuel delivery cycles are performed, the residual pressurized fuel will continue to be 'boot-strapped' into the high pressure manifold 216, as described above, until the injection conduits 218 and the high pressure manifold 216 have reached and stabilized at a predetermined elevated pressure. In one particular design embodiment, the pressure of the injection lines 218 and the high pressure manifold 216 stabilize at approximately 4000 psi, whereby detrimentally higher pressures are guarded against through the action of the pressure relief valve assembly 230 which shunts excessive pressure back to the fuel pump 212 for later use via a fuel return path 223.

Figure 1:
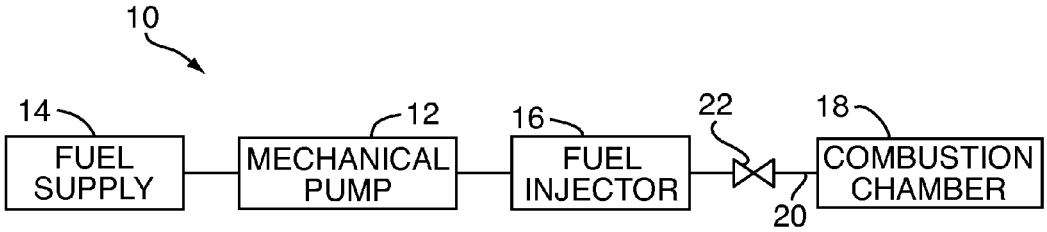
FIG. 1 PRIOR ART
FIG. 1 is a block diagram of a known fuel delivery system for internal combustion engines.

As will now be appreciated, once a state has been reached in which the injection conduits 218 and the fuel manifold 216 have stabilized at a predetermined elevated pressure (approximately 4000 psi, in the example above), each subsequent fuel delivery cycle will begin and end at a scaled pressure which is substantially higher than normal and higher than the predetermined elevated pressure. A graph illustrating the forgoing pressure architecture during operation of the injection apparatus 200 can be seen in previously discussed FIG. 5. As can be seen from FIG. 5, although the pressure curve 150 has similar characteristics to the pressure curve 50 of known fuel delivery systems as illustrated previously in FIGS. 1 and 2, the pressure of the injected fuel remains high even during the later stages of each fuel delivery cycle, owing to the elevated pressure maintained in the high pressure manifold 216 and the injection conduits 218 as a result of the bootstrapping of pressurized fuel.

Similar to the operation of the injection apparatus 100 of FIGS. 3 and 4, the injection apparatus 200 ensures that the fuel streams provided to the combustion chamber of a motorized vehicle are maintained at an elevated pressure, especially at the nozzles 220, thereby ensuring a more complete combustion of these fuel streams and an associated reduction in exhausted polluting contaminants.

Moreover, the injection apparatus 200 illustrated in FIGS. 6 and 7 may be incorporated onto existing motorized vehicles without incurring significant expenses. In order to accommodate the injection apparatus 200 into existing fuel delivery systems, an electrically actuated valve 240, typically a solenoid or the like, is provided between the high pressure manifold 216 and the fuel pump 212. The solenoid valve 240 is actuated to vacate pressure within the high pressure manifold 216 during the initial cranking of the motorized vehicle's engine, to be in conformance with the motorized vehicle's original pressure design parameters. Once the vehicle has started, the solenoid valve 240 would again be actuated to enable the fuel delivery routine as described above. While the primary function of the solenoid valve 240 is to reduce the build-up of pressure during a starting operation, the present invention also contemplates actuating the solenoid valve 240 in order to lower the opening and closing pressures of the nozzles 220 during low idle to reduce idling noise and the like.

As best seen in FIG. 6, the injection apparatus 200 utilizes the leak-off conduits 222, which are typically present in standard fuel delivery systems, to assist in the bootstrapping of pressurized fuel. The present invention may therefore be easily adapted to existing systems, as well as being more efficient. In certain circumstances, it may be necessary to adjust the tubing or conduit sizes, as well as the size of the nozzles 220 themselves, in order to make the injection apparatus 200 work as designed at all engine operating speeds and for all fuel delivery demands, and the present invention contemplates such modifications without departing from the broader aspects of the present invention, as discussed previously.

As can be seen from the foregoing disclosure and figures in combination, a controlled nozzle injection apparatus according to the present invention is advantageously provided with a plurality of beneficial operating attributes, including, but not limited to: enabling high starting pressure at the beginning of a fuel delivery cycle, maintaining higher end pressures at the conclusion of a fuel delivery cycle, reducing the exhaust of polluting contaminants and recycling excess pressurized fuel for later use. All of these attributes contribute to the efficient operation of an internal combustion engine and are especially beneficial in those situations where the retro-fitting of existing internal combustion engines are necessary in order to address ever increasingly stringent environmental concerns and regulations.

Figure 8:
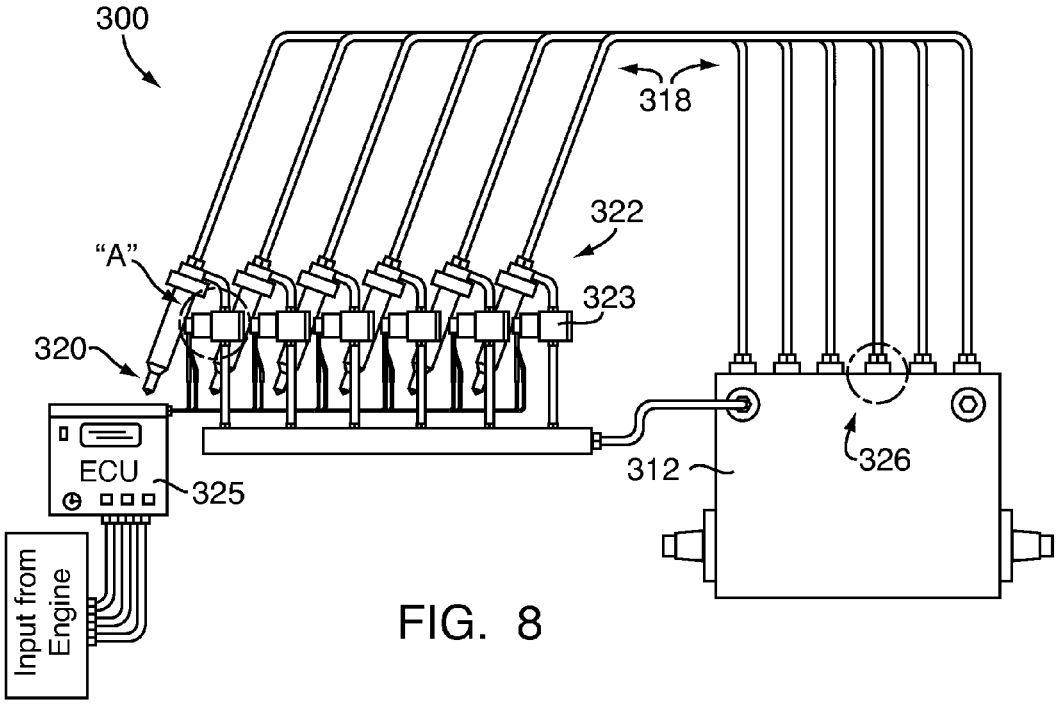
FIG. 8 illustrates a controlled nozzle injection apparatus according to another embodiment of the present invention.

FIG. 8 illustrates a controlled hydraulic nozzle injection apparatus 300 according to yet another embodiment of the present invention. As shown therein, the injection apparatus 300 is similar to the apparatus 200 of FIG. 6 in many respects.

As with the injection apparatus of FIG. 6, a fuel injection pump 312 is provided to intermittently supply the injection apparatus 300 with a pressurized stream of fuel, typically a hydrocarbon fuel comprising gasoline, diesel fuel or the like. The pump 312 operates to send streams of pressurized fuel through, in succession, a plurality of dual valve assemblies 326, a plurality of fuel injection conduits 318 and, finally, to a plurality of fuel injector nozzles 320 which exhaust the fuel streams into an unillustrated combustion chamber of a vehicle.

Each of the nozzles 320 typically include a known arrangement of needle valves or the like which, when subjected to a threshold pressure, will permit passage of the pressurized fuel into the combustion chamber. Moreover, as with the apparatus 200 of FIG. 6, although there are a discreet number of conduits 318 and fuel injector nozzles 320 shown in FIG. 8, it will be readily appreciated that the present invention contemplates the incorporation of any number of conduits or nozzles without departing from the broader aspects of the present invention.

A manifold 316 is provided and is connected to each of the leak-off conduits 322 of the nozzles 320 in order to assist in boot-strapping the residual pressurized fuel. The high pressure manifold 216 is further connected to the fuel pump 312 and serves to vacate pressurized fuel from the manifold 316, back to the fuel pump 312.

As will be readily appreciated, however, the apparatus 200 of FIG. 6 may not necessarily be pressure balanced, i.e., the pressures in each of the nozzles 220 and injection conduits 218 may not necessarily be uniform. As shown in FIG. 8, in order to address any non-uniform pressures that may be present, each nozzle 320 is further configured with an electronic control valve and pressure sensor 323 upstream of the manifold 316. In particular, the electronic control valves and pressure sensors 223 are located along the leak-off conduits 322, between the nozzles 320 and manifold 316. As discussed in detail below, the presence of the electronic control valve and pressure sensor 323 allows the pressure in each line 318 to be dynamically and selectively controlled and set for any desired stabilization pressure values, including values in excess or different than 4000 psi. In particular, it allows the pressure at each nozzle 320 to be controlled independently with respect to the pressures at the other nozzles 320.

Figure 10:
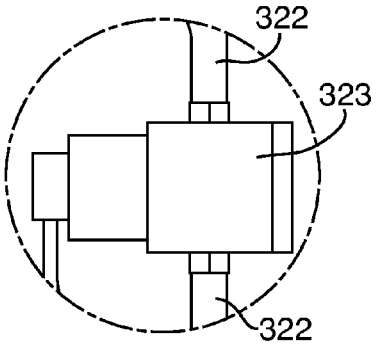
FIG. 10 is an enlarged view of area "A" of FIG. 8 and depicts a control valve assembly utilized in the injection apparatus of FIG. 8.

The control valve and pressure sensor assembly 323 is best shown in FIG. 10. The control valve may be any type of control valve or pressure relief valve known in the art, such as a solenoid and the like, and serves to vacate pressurized fuel from each nozzle 320 to the manifold 316, when necessary. As shown therein, each control valve assembly 323 is in electrical communication with an engine control unit 325, which is, in turn, in electrical communication with the engine and receives input from the engine. As will be readily appreciated, the engine control unit determines the amount of fuel, ignition timing and other parameters of the internal combustion engine needed to keep the engine running smoothly. It does this by reading and interpreting input values from the engine, e.g., engine speed, calculated from signals coming from sensor devices monitoring the engine. These input values from the sensor devices in the engine are fed to the engine control unit 325, which then analyzes this information. The pressure sensors of the control valve assemblies 323 also feed information, in the form of the pressure detected at each nozzle 320, to the engine control unit 325 for reading and processing.

In operation, the engine control unit 325 sends a signal to one or more of the control valve assemblies 323 to open or close the control valves in dependence upon the particular operating parameters of the engine, as detected by the sensor devices, and in dependence upon the pressure readings obtained by the pressure sensors of the control valve assemblies 323. In this respect, the control valve assemblies 323, in combination with the engine control unit 225, are capable of dynamically and selectively controlling the pressures within each of the nozzles 320.

As will be readily appreciated, the control valve assemblies 323 allow for the reduction of build-up of pressure in each nozzle 320, e.g., during a starting operation, and can also be selectively actuated in order to lower the opening and closing pressure of each nozzle during low idle to reduce idling noise and the like, or at other times as necessary and in dependence upon readings from the sensor devices. In addition, the control valve assemblies 323 also allow for the build-up of pressure in each nozzle, by maintaining the control valve assemblies 323 in a closed condition, if necessary.

Importantly, the addition of a control valve assembly 323 to each nozzle 320 along each leak-off conduit 322 allows the pressure at each nozzle 320 and injection conduit 318 to be more precisely controlled, further reducing emissions. In particular, the injection apparatus 300 ensures that each individual fuel stream provided to the combustion chamber is maintained at a precise elevated pressure, especially at the nozzles 320, thereby ensuring a more complete combustion of these fuel streams and an associated reduction in exhausted polluting contaminants. In addition, the pressure range and duration at each nozzle 320 may also be controlled with the addition of the control valve assembly/pressure sensor device 323.

While FIG. 8 illustrates a control valve and pressure sensor 323 for each leak-off conduit 322, it is contemplated that any number, for example less than all, of the leak-off conduits 322 can be configured with a control valve and pressure sensor, without departing from the broader aspects of the present invention. Indeed, the controlled hydraulic nozzle injection apparatus 300 includes as many as one control valve 323 for each leak-off conduit 322, and the exact number of such devices may be determined by the starting requirements of a particular engine.

Figure 9:
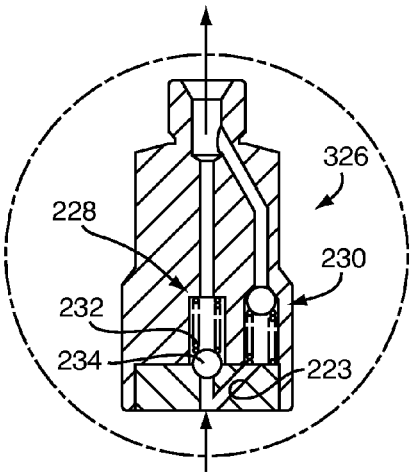
FIG. 9 is an enlarged, partial cross-sectional view of a dual valve assembly utilized in the injection apparatus of FIG. 8.

In operation of the injection apparatus 300, the fuel pump pressurizes a predetermined amount of fuel from an unillustrated fuel supply. As best shown in FIG. 9, once the pressurized fuel overcomes the biasing force of a check spring 232, a check ball valve will be displaced, thereby allowing the pressurized stream of fuel to pass through the injection conduits 318 on the way to the nozzles 320 where a needle valve, or the like, opens and releases an atomized fuel stream into the combustion chamber of a motorized vehicle.

At the end of the initial fuel delivery cycle, the check ball valve 234 will resume its blocking position leaving a measured amount of residual fuel, and therefore pressure, trapped in the injection conduits 318. As with the apparatus 200 of FIG. 6, while known systems remove this residual pressure, the present invention arrests the remaining pressurized fuel by virtue of the pressure relief valve assembly 230. Further operation of the apparatus 300, in some embodiments, follows the operation of the apparatus 200 described above in connection with FIG. 6. In any event, however, the addition of a pressure control valve 323 for each fuel injection nozzle 322 and each injection conduit 318 allows the pressure of fuel within each conduit 318 and at each nozzle 322 to be precisely controlled at almost any point in the fuel delivery process. In particular, the pressure within each conduit and at each nozzle 322 can be dynamically and selectively controlled, and can be controlled independent of the other nozzles 322 and conduits 318, in dependence upon readings from the associated pressure sensor and input information from the engine regarding engine operating parameters and conditions. As will be readily appreciated, this added level of control further reduces undesirable emissions and provides for more complete combustion of atomized fuel.

Figure 11:
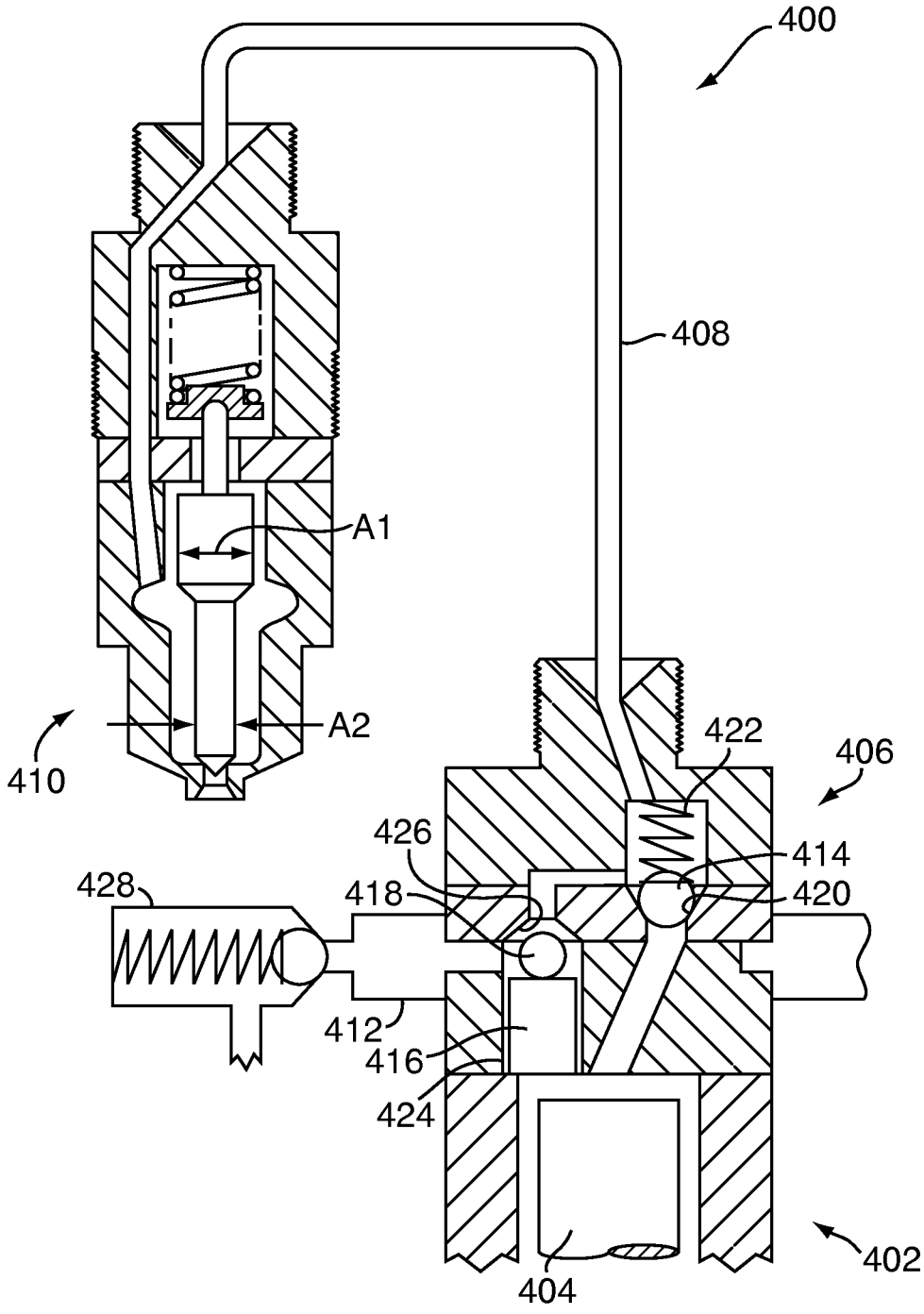
FIG. 11 is partial cross-sectional view of a controlled nozzle injection apparatus according to one embodiment of the present invention.

As discussed above, FIG. 3 shows the injection lines of a conventional fuel injection pump 112 connected to a manifold having a plurality of valve sets 125 which are utilized to control the flow and pressure of the fuel streams provided by the fuel pump 112. FIG. 4 is an enlarged, partial cross-sectional view of the valve sets 125 utilized to control the flow and pressure of the fuel streams in accordance with the present invention. Referring now to FIG. 11, a controlled nozzle injection apparatus 400 according to another embodiment of the present invention is shown, in which piston and ball valves are utilized to control the flow of fuel, as discussed hereinafter.

As shown in FIG. 11, a fuel injection pump 402 having a pumping plunger 404 is provided to intermittently supply the injection apparatus 400 with a pressurized stream of fuel. As discussed above, the fuel is typically a hydrocarbon fuel comprising gasoline, diesel fuel or the like. The pump 402 operations to send streams of pressurized fuel through, in succession, a valve assembly 406, a fuel injection conduit 408 or conduits and, finally, to a fuel injector nozzle 410, or a plurality thereof, which exhaust the fuel streams into an unillustrated combustion chamber of a vehicle. A fuel return conduit 412 is also provided for depressurizing the high pressure injection conduit 408.

As with the embodiments discussed above, each of the nozzles 410 typically include a known arrangement of needle valves or the like which, when subjected to a threshold pressure, will permit passage of the pressurized fuel into the combustion chamber. The nozzles 410 do not, however, include leak off valves, conduits or the like which are typically provided to known nozzle assemblies to evacuate residual fuel therefrom (as discussed previously). The present embodiment utilizes such leakless nozzles in order to trap residual, pressurized fuel within an unillustrated spring chamber of the needle valves for subsequent use. Moreover, although there are a discreet number of conduits and fuel injector nozzles shown in FIG. 11, it will be readily appreciated that the present invention contemplates the incorporation of any number of conduits or nozzles without departing from the broader aspects of the present invention.

As further shown in FIG. 11, the valve assembly 406 is provided with a plurality of differing valve sets which are utilized to control the flow and pressure of the fuel streams provided by the fuel pump 402. FIG. 11 is an enlarged, partial cross-sectional view of the valve assembly utilized to control the flow and pressure of the fuel streams in accordance with the present invention.

As shown in FIG. 11, a spring-biased ball 414 works in concert with a piston 416 and ball 418 to bootstrap residual pressure left in the injection apparatus 400 at the conclusion of each fuel cycle. By doing so, the present invention maintains high fuel injection pressures at the end of the fuel delivery cycle, similar to the high injection pressures present at the beginning of the fuel delivery cycle.

Operation of the injection apparatus 400 will now be described in conjunction with FIG. 11. By way of example, if a 3000 psi residual pressure is desired, then fuel is supplied by the pump 402 and the residual pressure control valve 401 would be set for 3000 psi. If operation is picked up during injection, the pressure in the injection line 408 is approximately 12,000-15,000 psi and the nozzle is open and flowing fuel. Some fuel may leak past the nozzle valve of the nozzle 410 and into the nozzle spring chamber. The spring chamber of the nozzle(s) 410 is sealed (leakless nozzle) so that leakage will increase the spring chamber pressure. In between injections, the residual line pressure is 3000 psi and some fuel will leak out of the spring chamber into the nozzle end of the injection line 408. As a result, the spring chamber pressure will be equal to the average line pressure, typically 90% of the residual pressure plus 10% of the peak line pressure, in this example 3500 psi. In an embodiment, for starting, the residual pressure control valve 401 may be set for zero pressure in which case the nozzle opening pressure will be static nozzle opening pressure produced by the nozzle valve spring.

In between injections, spring biased ball 414 is pressed against its seat 420 by its spring 422 and by the 3000 residual pressure in the line. Similarly, piston 416 is pressed against its minimum travel stop 424. At the start of the next pumping event, piston 416 will be forced upward, holding ball 418 tightly against its seat 426 and preventing any backflow into the residual pressure circuit, i.e., return conduit 412. Ball 414 will be lifted off its seat 420, against the spring bias, and fuel will flow towards the nozzle 410. Pressure will build up in the nozzle 410 until it gets high enough to lift the nozzle valve. The nozzle valve is held closed by the spring force and by the spring chamber pressure acting on the nozzle valve. The pressure required to overcome the spring force is the static nozzle opening pressure (in this case somewhere around 2500 psi). The pressure required to overcome the spring chamber pressure depends on the nozzle geometry, however, it is typically 1.5 times the spring chamber pressure (in this case, approximately 5250 psi). This makes the net nozzle opening pressure 7750 psi, which cannot be easily obtained by spring force alone.

As will be readily appreciated, this high operating pressure is particularly advantageous when the nozzle valve is to be closed. In a conventional nozzle, it takes approximately 2500 psi acting on the net area (A1-A2) to develop enough force to overcome the spring force and begin to open the valve. As soon as the nozzle lifts off its seat, fuel flows into the nozzle sac (area A2). With pressure acting over the full area A1 (as opposed to the net area (A1-A2), the nozzle valve snaps open. At closing, the pressure must drop well below the static opening pressure before the net force (i.e. the pressure acting over the full area A1) drops below the spring force. Dynamically, in a conventional nozzle, the nozzle pressure must drop much further, perhaps below 1500 psi, before there is enough force imbalance to accelerate the nozzle valve in the closing direction. At such time, the engine cylinder pressure is high and the net pressure drop across the nozzle orifices will be small. As a result, fuel may dribble out of the nozzle at the end of injection, and there is even a danger that combustion gases could be forced through the nozzle holes into the nozzle.

With the apparatus 400 of the present invention, however, the spring chamber pressure plus the spring force combine to force the nozzle valve closed. The nozzle valve acts as a pump and forces the last bit of fuel out of the nozzle 410 and maintaining good atomization right until the very end of injection.

With further reference to FIG. 11, to complete the cycle, the pumping plunger spill ports (not shown) are opened, thus dropping the pumping chamber pressure. Ball 414 is forced against its seat 420 by its spring 422 and by the pressure in the injection line 408. Importantly, ball 414 acts very much like a zero retraction delivery valve, trapping excess fuel in the line 408. Low pressure in the pumping chamber also allows piston 416 to move downward into contact with its minimum travel stop 424 such that ball 418 is no longer forced against it seat 426. A passageway is thereby created such that excess pressure in the line 408 can then flow past ball 418, bringing the line pressure down to the level of the residual pressure gallery 428. During every injection, a small quantity of fuel enters the residual pressure gallery 418, so a simple control valve may be utilized to bleed off the excess to maintain the desired residual gallery pressure (in this case approximately 3000 psi).

For example, as shown in FIG. 4, a simple spring loaded ball to control the residual pressure and a solenoid operated shuttle valve to turn the residual pressure control on and off may be utilized. Moreover, any number of mechanical and/or electrical systems can be utilized to control the residual pressure with whatever degree of sophistication is required.

In the embodiment shown in FIG. 11, valves 414 and 418 are shown as balls acting on a conical seat, however, conical valves acting against conical seats may be utilized without departing from the broader aspects of the present invention to achieve even more reliable operation (i.e., conical valves may be more durable and reliable).

Figure 12:
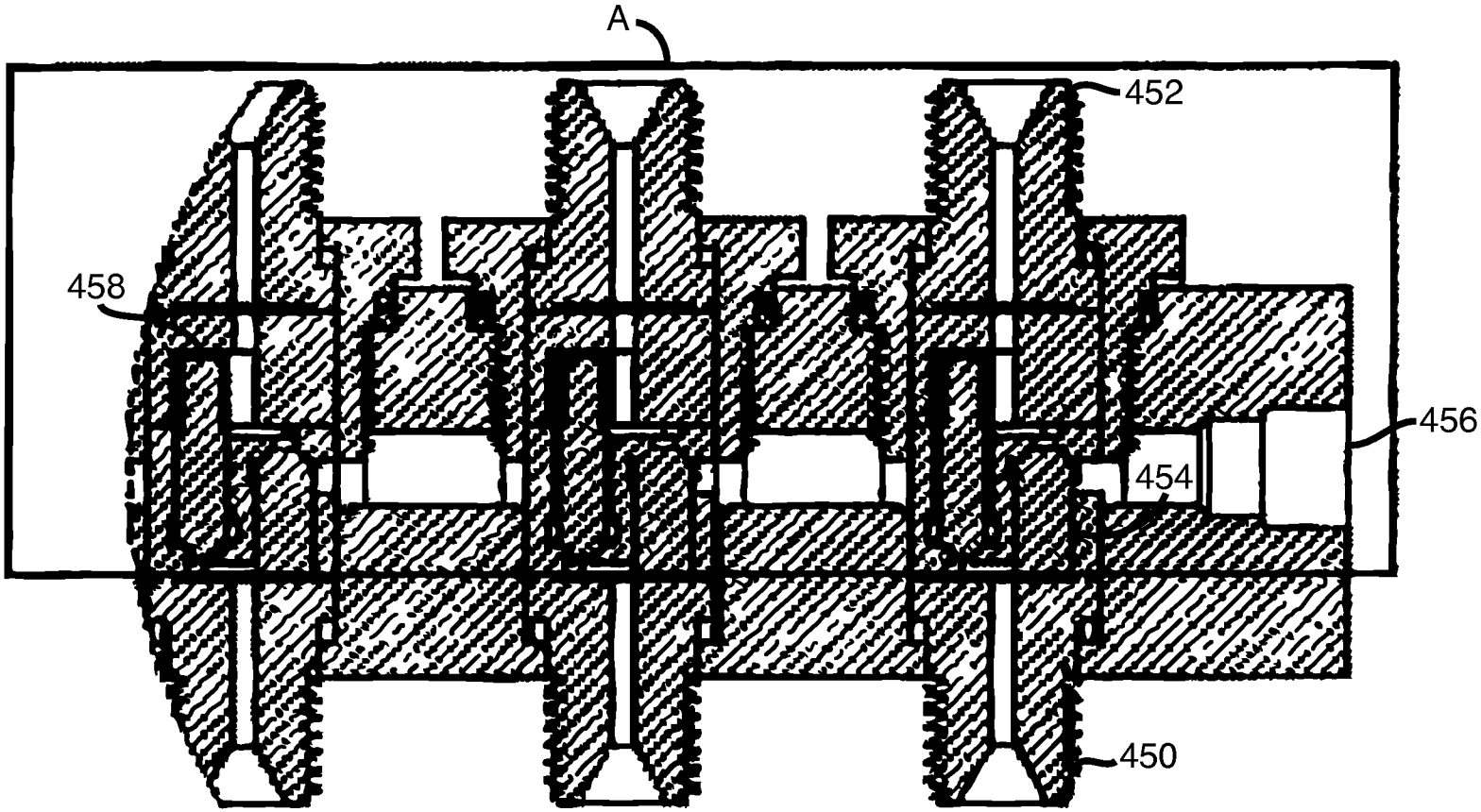
FIG. 12 is a schematic view of a controlled nozzle injection system according to an embodiment of the present invention.

As discussed above, the controlled hydraulic nozzle injection system 400 of the present invention allows a user to change nozzle opening and closing pressure while the engine is running. As also discussed above, there are two main parts to the system 400. The first part are control valves which may be installed in the injection lines between the pump and the nozzles, as shown in FIG. 12, or they may be built into the fuel injection pump, as discussed above in connection with FIG. 11. The second part of the system is a set of leakless nozzles. In an embodiment, the leakless nozzles may be conventional nozzles with the leakoff line sealed.

As shown in FIG. 12, in an embodiment where the control valves are installed in the injection lines, the assembly shown in box A may be grafted to the top of the pumping chamber. As shown therein, the components shown therein are substantially similar in arrangement to the valve assembly 406 shown in FIG. 11. In particular, the assembly in box A includes an injection line fitting 450 from the pumping chamber and an injection line fitting 452 to the nozzle inlet. The assembly includes a residual pressure valve 454 for controlling the pressure from a control pressure manifold via conduit 456 and a forward check valve 458 similar to ball valve 414.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A nozzle injection apparatus for use in internal combustion engines, said apparatus comprising:

a fuel pump for intermittently pressurizing fuel;

a leakless fuel injection nozzle;

an injection conduit in fluid communication with said fuel pump, said injection conduit permitting said pressurized fuel to be communicated to the leakless fuel injection nozzle;

a residual pressure gallery in fluid communication with said fuel pump and said nozzle;

a spring-biased first ball valve assembly for controlling the passage of pressurized fuel from said fuel pump to said nozzle, said first ball valve assembly being controllable between a first state in which a ball of said first ball valve assembly is biased against a corresponding seat, and a second state in which said ball is lifted off said seat against the force of said spring bias;

a second ball valve assembly for controlling the passage of residual pressurized fuel from said injection conduit to said residual pressure gallery, said second ball valve assembly being controllable from a first state in which a ball of said second ball valve assembly is biased against a corresponding seat to prevent the passage of pressurized fuel from said injection conduit to said residual pressure gallery, and a second position in which said ball is not in contact with said ball valve seat to permit the passage of pressurized fuel from said injection conduit to said residual pressure gallery; and a piston in operative communication with said ball of said second ball valve assembly, said piston being movable between a lowered position and a raised position upon pressurization of said fuel by said fuel pump;

wherein when in said raised position said piston forces said ball of said second ball valve assembly against its corresponding seat to prevent backflow of said pressurized fuel;

wherein said piston moves from said raised position to said lowered position when pressure in a pumping chamber of said fuel pump is lowered; and wherein when said piston in lowered, said ball of said second ball valve assembly retracts from its corresponding seat to permit excess pressure in said injection conduit to flow past said ball to bring the line pressure down to a pressure level in said residual pressure gallery.

2. The nozzle injection apparatus for use in internal combustion engines according to claim 1, further comprising:

a regulator in fluid communication with said residual pressure gallery for bleeding off excess pressure in said gallery to maintain a desired residual gallery pressure.

3. The nozzle injection apparatus for use in internal combustion engines according to claim 1, wherein:

said first ball valve assembly and said second ball valve assembly include conical valves acting against conical seats.

* * * * *